US005524744A

United States Patent [19]

Wohlrab

[11] Patent Number: 5,524,744

[45] Date of Patent: Jun. 11, 1996

[54] COIN RETURN MECHANISM FOR A COIN ACCEPTOR

[75] Inventor: Ekhart Wohlrab, Stade, Germany

[73] Assignee: National Rejectors, Inc. GmbH, Buxtehude, Germany

[21] Appl. No.: 250,794

[22] Filed: May 27, 1994

(Under 37 CFR 1.47)

[51] Int. Cl.[6] ..... G07F 1/04

[52] U.S. Cl. ..... 194/202; 194/345

[58] Field of Search ..... 194/321, 323, 194/344, 345, 347, 348, 349, 202, 203

[56] References Cited

U.S. PATENT DOCUMENTS 4,089,400 5/1978 Gregory, Jr. .
4,353,452 10/1982 Shah et al. .
4,881,630 11/1989 Kobayashi et al. ..... 194/203

FOREIGN PATENT DOCUMENTS 2122403 1/1984 United Kingdom ..... G07F 1/04
WO92/15075 9/1992 WIPO ..... G07F 1/04

*Primary Examiner*—F. J. Bartuska
*Attorney, Agent, or Firm*—Senniger, Powers, Leavitt & Roedel

[57] ABSTRACT

A coin acceptor which accepts authentic coins includes a main plate and a side plate pivotally attached to the main plate for allowing coins to pass therebetween when the side plate is in a first position. An opening lever is pivotally attached to a pivot pin formed from the main plate. Upon rotation, the opening lever pivots the side plate into a second position. A leaf spring biases the opening lever into a rest position corresponding to the side plate being in the first position. The opening lever has a shoulder which moves in rotation with the opening lever. The main plate has a slot for passing the shoulder therethrough to the other side of the plate. The leaf spring engages the shoulder for biasing the opening lever into the rest position. The shoulder also engages a switch arm of an electrical switch for switching the switch upon rotation of the opening lever from the rest position.

23 Claims, 3 Drawing Sheets

COIN RETURN MECHANISM FOR A COIN ACCEPTOR

BACKGROUND OF THE INVENTION

Coin acceptors having a main plate and a track carrier plate pivotally attached to the main plate are known. A coin track passes between the two plates. One or more sensors positioned along the track tests the validity of passing coins.

Vending machines equipped with coin acceptors often include a coin return mechanism which can be actuated at will by the user in order to interrupt the coin acceptance procedure and return inserted coins. For this purpose, coin acceptors often include an opening lever which cooperates with the coin return mechanism in a vending machine. The opening lever pivots the track carrier plate relative to the main plate against a spring. This pivoting movement separates the plates and allows any coins which may be caught or clamped between the plates to fall out into a coin return conduit. The opening lever usually rests on a metal pivot pin attached to the main plate. A helical return spring positioned on the pivot pin biases the opening lever toward the position where coins are not returned.

The opening lever as well as the mounting for the opening lever have several disadvantages in traditional coin acceptors. The use of a bearing pin for the opening lever is relatively complicated in that the pin must be manufactured separately and must be attached to the main plate which is usually plastic. Further, the opening lever and the bearing pin each require a minimum depth so that the mounting of the opening lever requires a relatively large amount of space. In addition, the return spring should generate a minimum pretension on the opening lever in the rest position. This makes manufacture more difficult. The use of a helical return spring is also relatively expensive.

SUMMARY OF THE INVENTION

Among the objects of the present invention are to provide improved coin acceptors having a coin return which is reliable and compact; to provide improved coin acceptors having a coin return mechanism which is easy to operate; to provide improved coin acceptors having a coin return mechanism which is biased with a leaf spring; to provide improved coin acceptors which protect against theft; and to provide improved coin acceptors which are easy and inexpensive to manufacture.

Generally, one form of the invention is a coin acceptor including a main plate and a side plate pivotally attached to the main plate which allow coins to pass therebetween when the side plate is in a first position. The coin acceptor includes an opening lever pivotally attached to one of the plates. The opening lever causes the side plate to pivot into a second position upon rotation of the opening lever. A leaf spring biases the opening lever into a rest position corresponding to the side plate being in the first position. The opening lever also includes a shoulder which moves in rotation with the opening lever. The leaf spring engages the shoulder for biasing the opening lever into the rest position.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
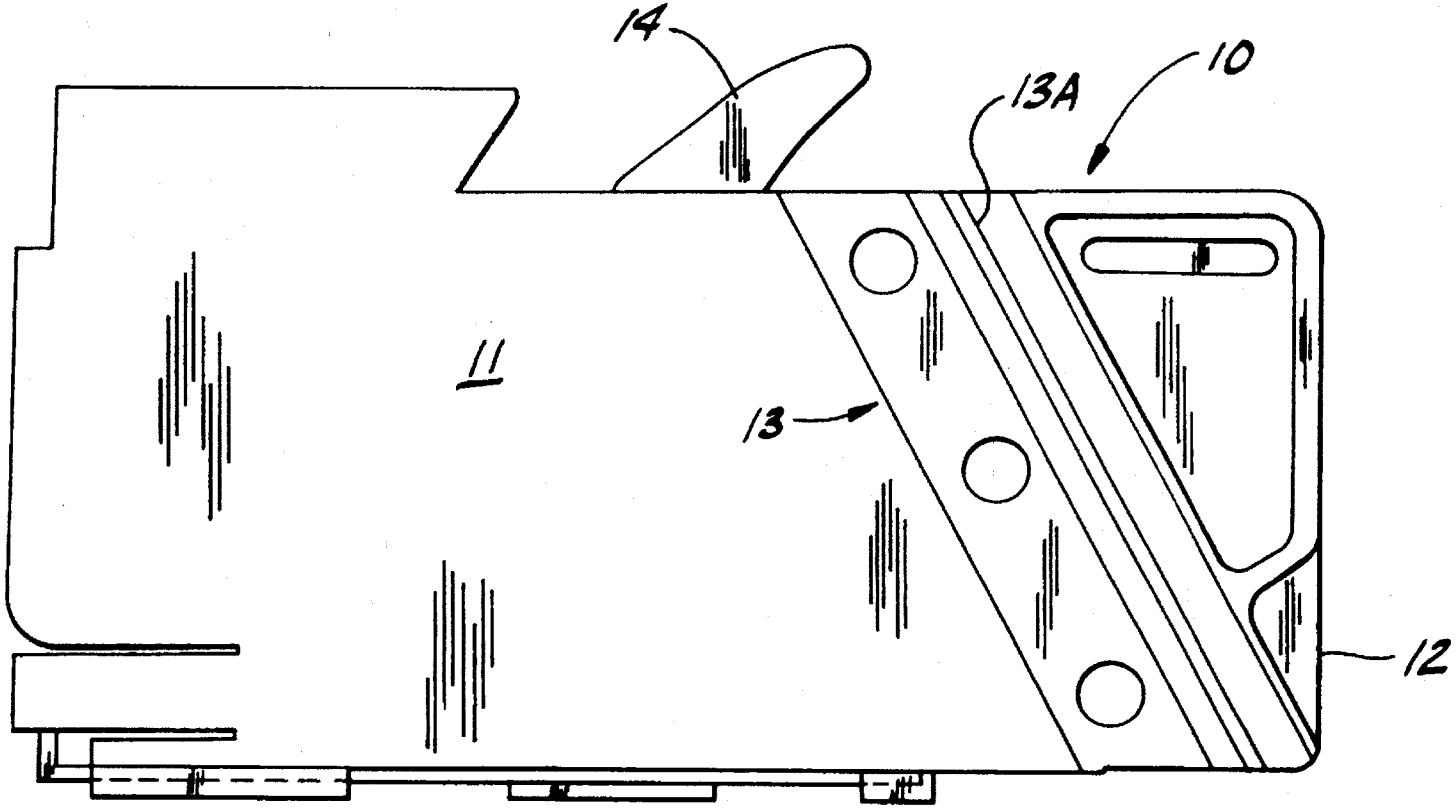
FIG. 1 shows the track carrier plate pivotally mounted on the main plate.

FIG. 1 shows a coin acceptor 10 having a track carrier plate 11 mounted to a main plate 12 via a film hinge 13. A film section 13A physically connects track carrier plate 11 to main plate 12 for allowing plate 11 to pivot relative to plate 12 about the axis defined by film section 13A. An opening lever 14 is mounted to main plate 12 for pivoting track carrier plate 11 away from main plate 12 upon rotation of opening lever 14. Opening lever 14 and track carrier plate 11 cooperate in an overlapping manner in order to cause the pivoting.

Figure 2:
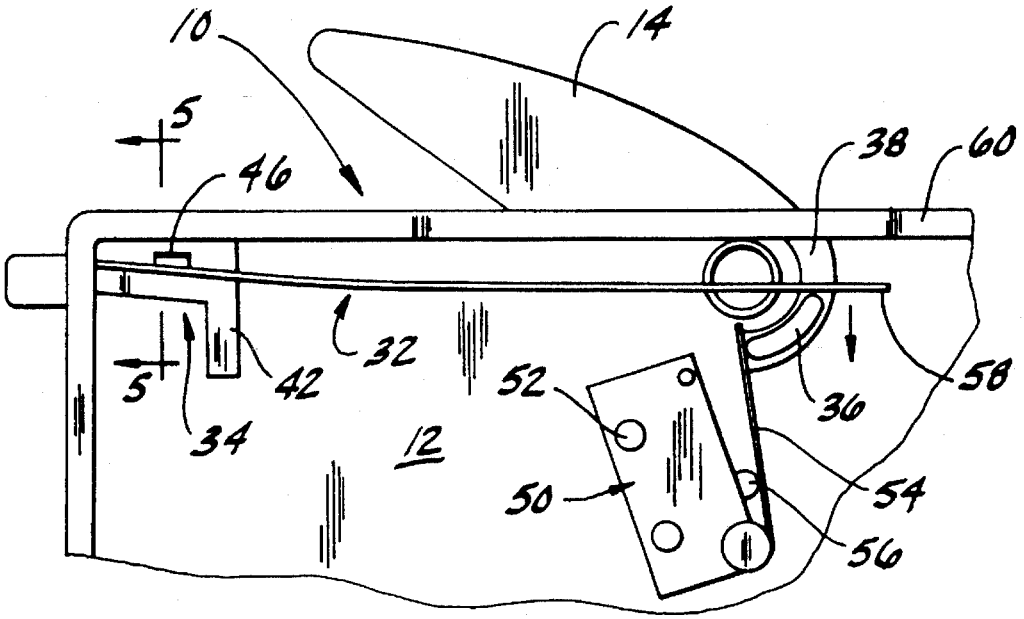
FIG. 2 shows a view of the upper part of a coin acceptor from the side facing away from the track carrier plate.
Figure 3:
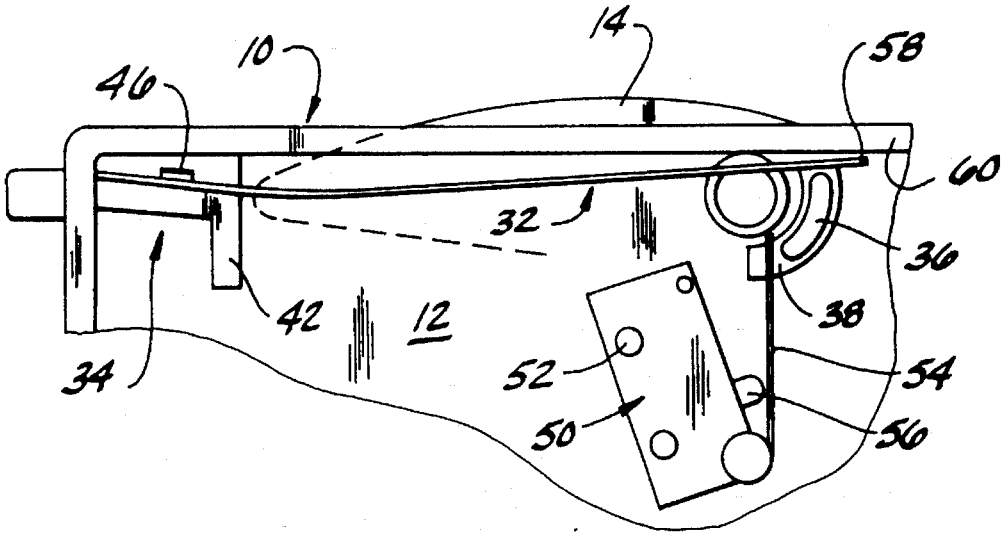
FIG. 3 shows a view similar to FIG. 2 but with the opening lever actuated.

FIGS. 2 and 3 show the back view of coin acceptor 10. Opening lever 14 is mounted on the side of main plate 12 associated with track carrier plate 11. Opening lever 14 includes a kidney-shaped shoulder 36 which projects through an arctuate guide slot 38 in main plate 12. As opening lever 14 is rotated in one direction and then the other, shoulder 36 contacts the end surfaces of guide slot 38 to define the endpoints of rotation of opening lever 14.

Figure 4:
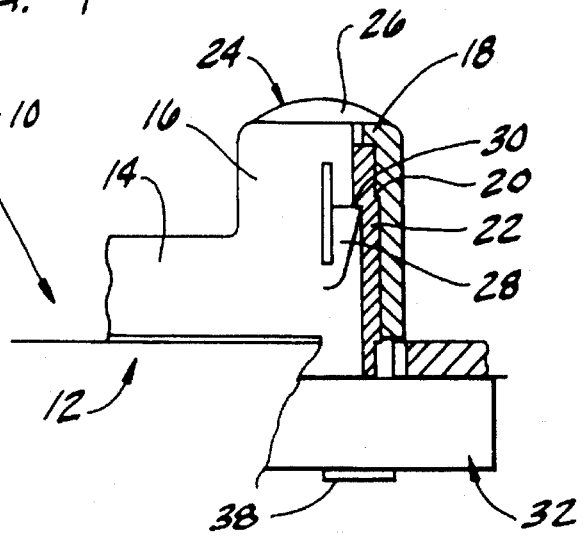
FIG. 4 shows a top view of the coin acceptor of FIG. 2 in the area of the opening lever with partially broken and cut sections.

FIG. 4 shows the mounting of opening lever 14 in more detail. Opening lever 14 is preferably made of plastic and includes a bearing sleeve 16. Bearing sleeve 16 has an inwardly directed flange 18 on its free end and an offset 20 on the inside of the bearing surface. A hollow pivot pin 22 formed in a one-piece manner with main plate 12 receives bearing sleeve 16. Flange 18 cooperates with the free front end of pivot pin 22 and offset 20 cooperates with a corresponding offset of pivot pin 22 so that the pushing of bearing sleeve 16 onto pivot pin 22 is limited. The offsets of pivot pin 22 and bearing sleeve 16 are spaced apart in order to avoid clamping and to reduce friction. A plastic expanding rivet 24 is inserted into the bore of pivot pin 22. A head 26 on rivet 24 rests against the outside of pivot pin 16 and fixes the axial position of opening lever 14. Rivet 24 has expansion sections 28 which extend behind an inner shoulder 30 of pivot pin 22.

As shown in FIGS. 2 and 3, a leaf spring 32 is located on the outside of main plate 12. Leaf spring 32 is fixed in a recess 34 at the left end in FIGS. 2 and 3 and it rests at the other end on the upper end of shoulder 36 of opening lever 14. A free end 58 of leaf spring 32 projects somewhat past shoulder 36. Leaf spring 32 and shoulder 36 are dimensioned so that free end 58 is pressed against an upper flange or limit stop 60 of main plate 12 when opening lever 14 is rotated counterclockwise as viewed in FIGS. 2 and 3. Accordingly, stop 60 sets the pivoting angle for opening lever 14. Free end 58 of leaf spring 32 is deformed from limit stop 60 to shoulder 36 as soon as leaf spring 32 comes to rest against limit stop 60. This achieves a sharply progressive spring behavior and a softer stop for opening lever 14 when it approaches its end position. Since free end 58 is very short, a considerable force is applied to shoulder 36. This brings about a further "braking" of opening lever 14 upon actuation than would occur with a rigid limit stop.

Figure 6:
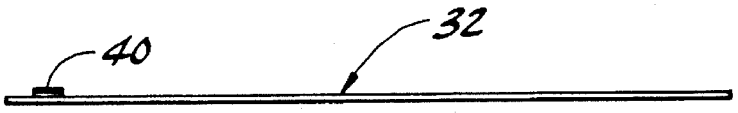
FIG. 6 shows a side view of the leaf spring shown in FIGS. 2 and 3.
Figure 7:
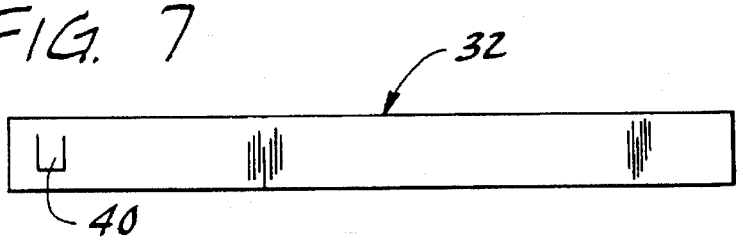
FIG. 7 shows a top view of the leaf spring of FIG. 6.

The form of leaf spring 32 is shown more clearly in FIGS. 6 and 7. Leaf spring 32 is cut off straight from a band material and is provided on one end with a flap 40 formed by stamping. The stamped-out section is bent somewhat out of the plane of leaf spring 32. Accordingly, leaf spring 32 is made of low cost materials and is inexpensive to manufacture.

Figure 5:
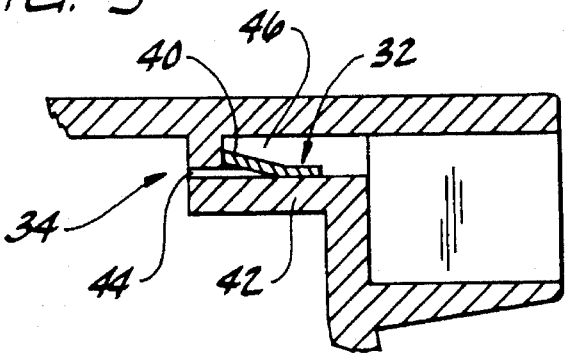
FIG. 5 shows a section through the view of FIG. 2 along line 5—5.

Main plate 12 is preferably formed from plastic so that a suitable recess 34 for leaf spring 32 can be formed as a part of main plate 12 in a simple manner. This also makes the mounting of the leaf spring very simple. For example, as shown in FIG. 5, recess 34 comprises a shoulder 42 formed in one piece with main plate 12 to provide a slot 44 extending over the length of shoulder 42. Slot 44 widens to provide a recess 46. During manufacture when leaf spring 32 is inserted into slot 44 transversally to the longitudinal extension, flap 40 snaps in the area of recess 46 behind the associated wall and is thereby fixed opposite to the direction of insertion. Leaf spring 32 is fixed in the direction of insertion by the back end of slot 44. Flap 40 also prevents movement of spring 32 in a longitudinal direction.

Accordingly, leaf spring 32 pretensions opening lever 14 in the rest position shown in FIG. 2. The magnitude of the pretension is determined by the type of material which leaf spring 32 is made from and by the angle of slot 44 which controls the amount of deformation of leaf spring 32 in the rest position. Leaf spring 32 is attached at a suitable angle to main plate 12 so that, as a result of the material used for spring 32 and of its dimensions, a set pretension is generated when it is brought together with shoulder 36 of opening lever 14. When opening lever 14 is pivoted counterclockwise as shown in FIG. 3, the tension of leaf spring 32 increases and attempts to move opening lever 14 back into the rest position.

FIGS. 2 and 3 also show a microswitch 50 fastened to main plate 12 on the same side as leaf spring 32 by means of pins 52 extruded as part of main plate 12. Microswitch 50 includes a switching lever 54 which cooperates with a contact pin 56. Switching lever 54 rests on shoulder 36 on the side facing away from spring 32. Consequently, microswitch 50 is actuated in the rest position of opening lever 14. On the other hand, if opening lever 14 is partly actuated as shown in FIG. 3, then switching lever 54 frees contact pin 56 which insures that a reliable switch closure is made.

Some users of coin acceptor 10 may try to manipulate opening lever 14 in order to obtain an improper credit or to improperly receive a coin after a credit has been issued. Past methods to counteract this have included deriving a signal simultaneously with the actuation of an opening lever. However, such a solution is expensive as regards manufacture and is difficult to assemble. Further, such signals do not always reliably counteract manipulations of opening lever 14. Accordingly, the present invention provides that shoulder 36 cooperates with switching lever 54 of microswitch 50. Impulses generated by microswitch 50 are easy to evaluate and can not be manipulated.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin acceptor comprising:

a main plate;

a side plate pivotally attached to the main plate for allowing the passage of coins therebetween when the side plate is in a first position;

an opening lever pivotally attached to one of the plates for pivoting the side plate into a second position upon rotation of the opening lever; and a leaf spring for biasing the opening lever into a rest position corresponding to the side plate being in the first position;

wherein the opening lever further comprises a shoulder which moves in rotation with the opening lever and wherein the leaf spring engages the shoulder for biasing the opening lever into the rest position.

2. The coin acceptor of claim 1 wherein the opening lever is pivotally attached to the main plate; wherein the leaf spring is fastened at one end to the main plate; and wherein the other end of the leaf spring engages the shoulder for biasing the opening lever.

3. The coin acceptor of claim 2 wherein the main plate further comprises a limit stop and wherein the shoulder presses the other end of the leaf spring against the limit stop upon rotation of the opening lever from the rest position.

4. The coin acceptor of claim 2 further comprising an electrical switch having a switch arm; wherein the shoulder engages the switch arm for switching the switch upon rotation of the opening lever from the rest position, whereby the electrical switch produces a signal indicating rotation of the opening lever.

5. The coin acceptor of claim 4 wherein the shoulder has an upper end and a lower end; wherein the upper end engages the leaf spring; and wherein the lower end engages the switch arm.

6. The coin acceptor of claim 2 further comprising a pivot pin; wherein the opening lever is axially affixed on the pivot pin for rotation thereabout; and wherein the pivot pin is form in one piece with one of the plates.

7. The coin acceptor of claim 2 further comprising a hollow pivot pin and an expanding rivet; wherein the expanding rivet axially affixes the opening lever on the hollow pivot pin for rotation of the opening lever about said pin.

8. The coin acceptor of claim 7 wherein the hollow pivot pin is formed in one piece with one of the plates.

9. The coin acceptor of claim 2 further comprising a slot on one of the plates for receiving one end of the leaf spring; wherein the leaf spring comprises a bent flap for engaging the slot to hold said end of the leaf spring in position in the slot.

10. The coin acceptor of claim 1 wherein the opening lever is pivotally attached to one side of one of the plates; wherein the leaf spring is located on the other side of said plate; and wherein said plate has a slot for passing the shoulder therethrough for enabling engagement of the shoulder with the leaf spring.

11. The coin acceptor of claim 10 further comprising an electrical switch having a switch arm; wherein the shoulder engages the switch arm for switching the switch upon rotation of the opening lever from the rest position, whereby the electrical switch produces a signal indicating rotation of the opening lever.

12. The coin acceptor of claim 11 wherein the shoulder has an upper end and a lower end; wherein the upper end engages the leaf spring; and wherein the lower end engages the switch arm.

13. The coin acceptor of claim 10 further comprising a pivot pin; wherein the opening lever is axially affixed on the pivot pin for rotation thereabout; and wherein the pivot pin is form in one piece with one of the plates.

14. The coin acceptor of claim 10 further comprising a hollow pivot pin and an expanding rivet; wherein the expanding rivet axially affixes the opening lever on the hollow pivot pin for rotation of the opening lever about said pin.

15. The coin acceptor of claim 14 wherein the hollow pivot pin is formed in one piece with one of the plates.

16. The coin acceptor of claim 10 further comprising a slot on one of the plates for receiving one end of the leaf spring; wherein the leaf spring comprises a bent flap for engaging the slot to hold said end of the leaf spring in position in the slot.

17. The coin acceptor of claim 1 further comprising an electrical switch having a switch arm; wherein the shoulder engages the switch arm for switching the switch upon rotation of the opening lever from the rest position, whereby the electrical switch produces a signal indicating rotation of the opening lever.

18. The coin acceptor of claim 17 wherein the shoulder has an upper end and a lower end; wherein the upper end engages the leaf spring; and wherein the lower end engages the switch arm.

19. The coin acceptor of claim 17 further comprising a pivot pin; wherein the opening lever is axially affixed on the pivot pin for rotation thereabout; and wherein the pivot pin is form in one piece with one of the plates.

20. The coin acceptor of claim 1 further comprising a pivot pin; wherein the opening lever is axially affixed on the pivot pin for rotation thereabout; and wherein the pivot pin is form in one piece with one of the plates.

21. The coin acceptor of claim 1 further comprising a hollow pivot pin and an expanding rivet; wherein the expanding rivet axially affixes the opening lever on the hollow pivot pin for rotation of the opening lever about said pin.

22. The coin acceptor of claim 20 wherein the hollow pivot pin is formed in one piece with one of the plates.

23. The coin acceptor of claim 1 further comprising a slot on one of the plates for receiving one end of the leaf spring; wherein the leaf spring comprises a bent flap for engaging the slot to hold said end of the leaf spring in position in the slot.

* * * * *